US006457310B1

(12) United States Patent
Hohkita et al.

(10) Patent No.: US 6,457,310 B1
(45) Date of Patent: Oct. 1, 2002

(54) EXHAUST TURBOCHARGER FOR INTERNAL COMBUSTION ENGINE AND TURBOCHARGING SYSTEM

(75) Inventors: Atsushi Hohkita, Hitachi (JP); Toshiyuki Katsuno, Hitachinaka (JP); Teruo Chida, Hitachi (JP)

(73) Assignees: Hitachi, Ltd., Tokyo (JP); Hitachi Car Engineering Co., Ltd., Hitachinaka (JP)

( * ) Notice: Subject to any disclaimer, the term of this patent is extended or adjusted under 35 U.S.C. 154(b) by 0 days.

(21) Appl. No.: 09/790,529

(22) Filed: Feb. 23, 2001

(30) Foreign Application Priority Data

Aug. 8, 2000 (JP) ..... 2000-240344

(51) Int. Cl.[7] ..... F02B 33/44
(52) U.S. Cl. ..... 60/605.3; 60/605.1; 60/608
(58) Field of Search ..... 60/605.2, 605.1, 60/605.3, 608

(56) References Cited

U.S. PATENT DOCUMENTS 4,622,817 A * 11/1986 Kobayashi ..... 60/608
5,560,208 A * 10/1996 Halimi et al. ..... 60/608
RE36,609 E * 3/2000 Halimi et al. ..... 60/608
6,176,224 B1 * 1/2001 Wu et al. ..... 123/527

FOREIGN PATENT DOCUMENTS

JP A 48-72511 9/1973

* cited by examiner

*Primary Examiner*—Hoang Nguyen
(74) *Attorney, Agent, or Firm*—Crowell & Moring LLP

(57) ABSTRACT

A turbine impeller to be driven for rotation by exhaust gas of an internal combustion engine is fixed to a turbine shaft. The turbine shaft is supported by a radial bearing in radial directions and mounted to a bearing housing. The turbine shaft includes a stepped part which is formed between the turbine impeller and the radial bearing so that the outer diameter of the turbine shaft is greater at the turbine impeller side than at the radial bearing side. The bearing housing includes an oil drain for discharging oil which has lubricated the radial bearing. The distance L from a side face of the radial bearing to the stepped part is set to a value at which oil moving from an end of the radial bearing does not reach the stepped part when a turbine-revolution speed Nt is higher than that Nti which is produced by an idling operation of the internal combustion engine.

6 Claims, 8 Drawing Sheets

EXHAUST TURBOCHARGER FOR INTERNAL COMBUSTION ENGINE AND TURBOCHARGING SYSTEM

BACKGROUND OF THE INVENTION

1. Field of the Invention

The present invention relates to an exhaust turbocharger and a turbocharging system.

2. Description of the Related Art

In known exhaust turbines for internal combustion engines, turbine shafts are rotatably supported by radial bearings, and the radial bearings are lubricated with oil, in which there is a problem in that white smoke is produced when the lubrication oil leaks from turbine-impeller sides into exhaust pipes. Accordingly, a known exhaust turbine for an internal combustion engine is disclosed in, for example, JP-A-48-72511, in which the lubrication oil is prevented from leaking to the turbine impeller side by making the lubrication oil spattering toward a radial bearing side by using a groove formed in a stepped portion disposed on a turbine shaft.

However, in the exhaust turbine disclosed in, for example, JP-A-48-72511, there is a risk in that the spattering lubrication oil penetrates into a gap between an outer surface of the turbine shaft and a bearing housing. The problem is caused by a fact in that although a seal ring is provided between the turbine shaft and the bearing housing, a pressure difference $\Delta P$ (Pt−Ph) at the seal ring changes in pulsation between positive and negative pressures, the pressure difference $\Delta P$ being between pressure Pt at the turbine impeller side of the seal ring which changes due to exhaust-pulsation and pressure Ph at an oil drain side of the seal ring which is substantially constant at ambient pressure. The lubrication oil leaks to the turbine impeller side when the pressure difference AP becomes negative.

The inventors have confirmed that the oil is more likely to penetrate into the gap between the outer surface of the turbine shaft and the bearing housing, as the rotation of turbine is more reduced. Recently, in motor vehicles, engine-idling speed tends to be reduced in order to reduce fuel consumption. Consequently, the rotational speed of turbines decreases, whereby lubrication oil is likely to leak.

SUMMARY OF THE INVENTION

Accordingly, it is an object of the present invention to provide an exhaust turbocharger for an internal combustion engine, in which leakage of lubrication oil can be suppressed.

To the end, according to an aspect of the present invention, an exhaust turbocharger for an internal combustion engine comprises a turbine shaft fixed to a turbine impeller to be driven for rotation by exhaust gas of the internal combustion engine; a radial bearing mounted to a bearing housing, for supporting the turbine shaft in radial directions, the bearing housing including an oil drain for discharging oil which has lubricated the radial bearing; and a stepped part formed on the turbine shaft between the turbine impeller and the radial bearing so that the outer diameter of the turbine shaft is greater at the turbine impeller side than at the radial bearing side. The distance L from an end of the radial bearing to the stepped part is set to a value at which oil moving from the end of the radial bearing does not reach the stepped part when a turbine-revolution speed Nt is higher than that Nti which is produced by an idling operation of the internal combustion engine.

With this arrangement, oil-spatter can be suppressed, whereby oil leakage can be avoided.

According to another aspect of the present invention, an exhaust turbocharger for an internal combustion engine comprises a turbine shaft fixed to a turbine impeller to be driven for rotation by exhaust gas of the internal combustion engine; a radial bearing mounted to a bearing housing, for supporting the turbine shaft in radial directions, the bearing housing including an oil drain for discharging oil which has lubricated the radial bearing; and a stepped part formed on the turbine shaft between the turbine impeller and the radial bearing so that the outer diameter of the turbine shaft is greater at the turbine impeller side than at the radial bearing side. The oil drain is formed so as to open toward the turbine impeller side from a supporting part of the radial bearing and to enclose the stepped part of the turbine shaft. The distance L from an end of the radial bearing toward the turbine impeller, at which the turbine shaft becomes free from the radial bearing, to the stepped part of the turbine shaft is set to a value greater than a gap produced by a difference between an inner diameter D of a hole for receiving the radial bearing and an outer diameter d of the turbine shaft when the turbine shaft is disposed coaxially with the hole.

With this arrangement, oil-spatter can be suppressed, whereby oil leakage can be avoided.

In the exhaust turbocharger for an internal combustion engine, according to the present invention, an annular plate inserted at an outer side of said turbine shaft may be provided between the end of the radial bearing and said radial bearing.

With this arrangement, oil-spatter can be suppressed, whereby oil leakage can be avoided.

According to still another aspect of the present invention, turbocharging system comprises an exhaust turbocharger for an internal combustion engine, which includes a turbine shaft fixed to a turbine impeller to be driven for rotation by exhaust gas of the internal combustion engine, and a radial bearing mounted to a bearing housing, for supporting the turbine shaft in radial directions. The turbocharging system also includes a control member for increasing idling speed after an idling operation continues for a predetermined time.

With this arrangement, oil-spatter can be suppressed, whereby oil leakage can be avoided.

DESCRIPTION OF THE PREFERRED EMBODIMENTS

An exhaust turbocharger for an internal combustion engine according to a first embodiment of the present invention is described below with reference to FIGS. 1 to 3.

The configuration of the exhaust turbocharger for an internal combustion engine according to the embodiment is described below with reference to FIGS. 1 and 2.

Figure 1:
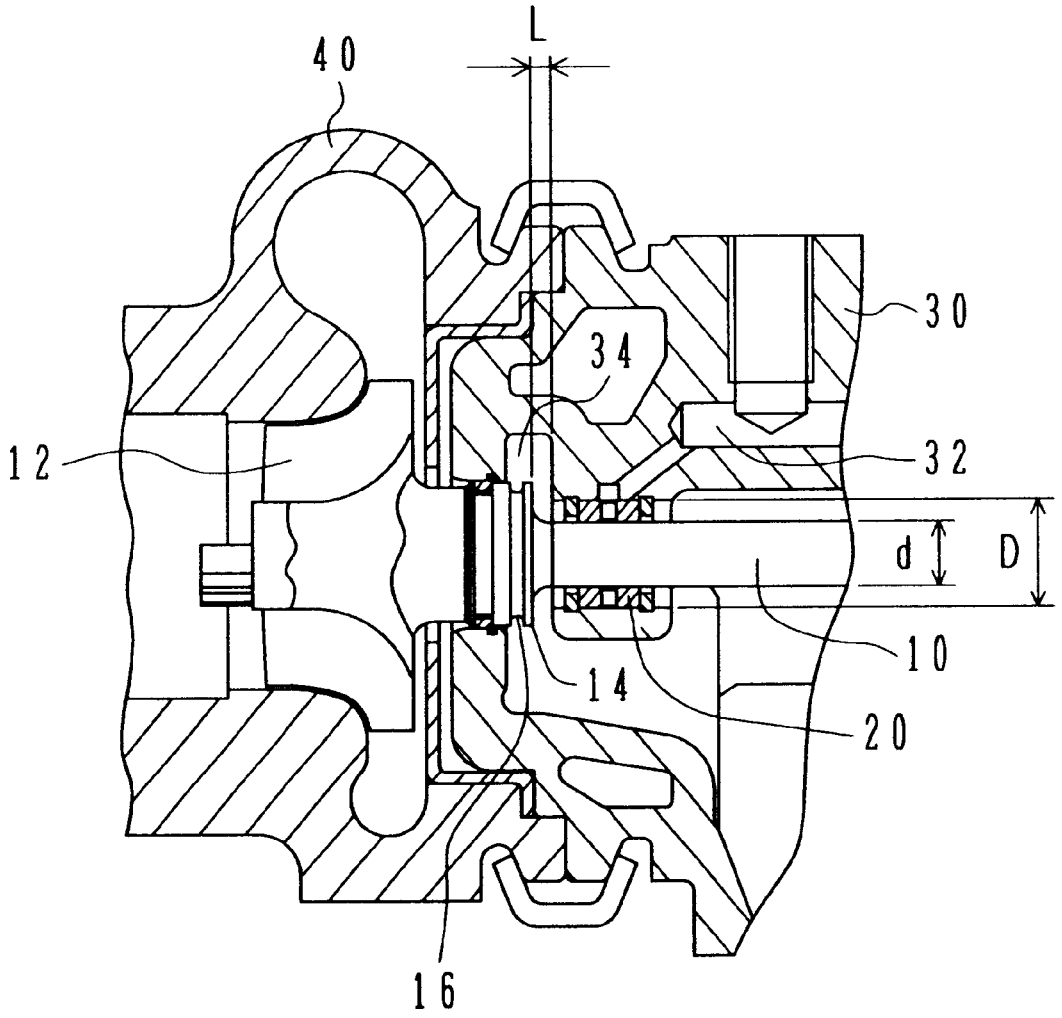
FIG. 1 is a partial sectional-view of an exhaust turbocharger for an internal combustion engine, according to a first embodiment of the present invention.
Figure 2:
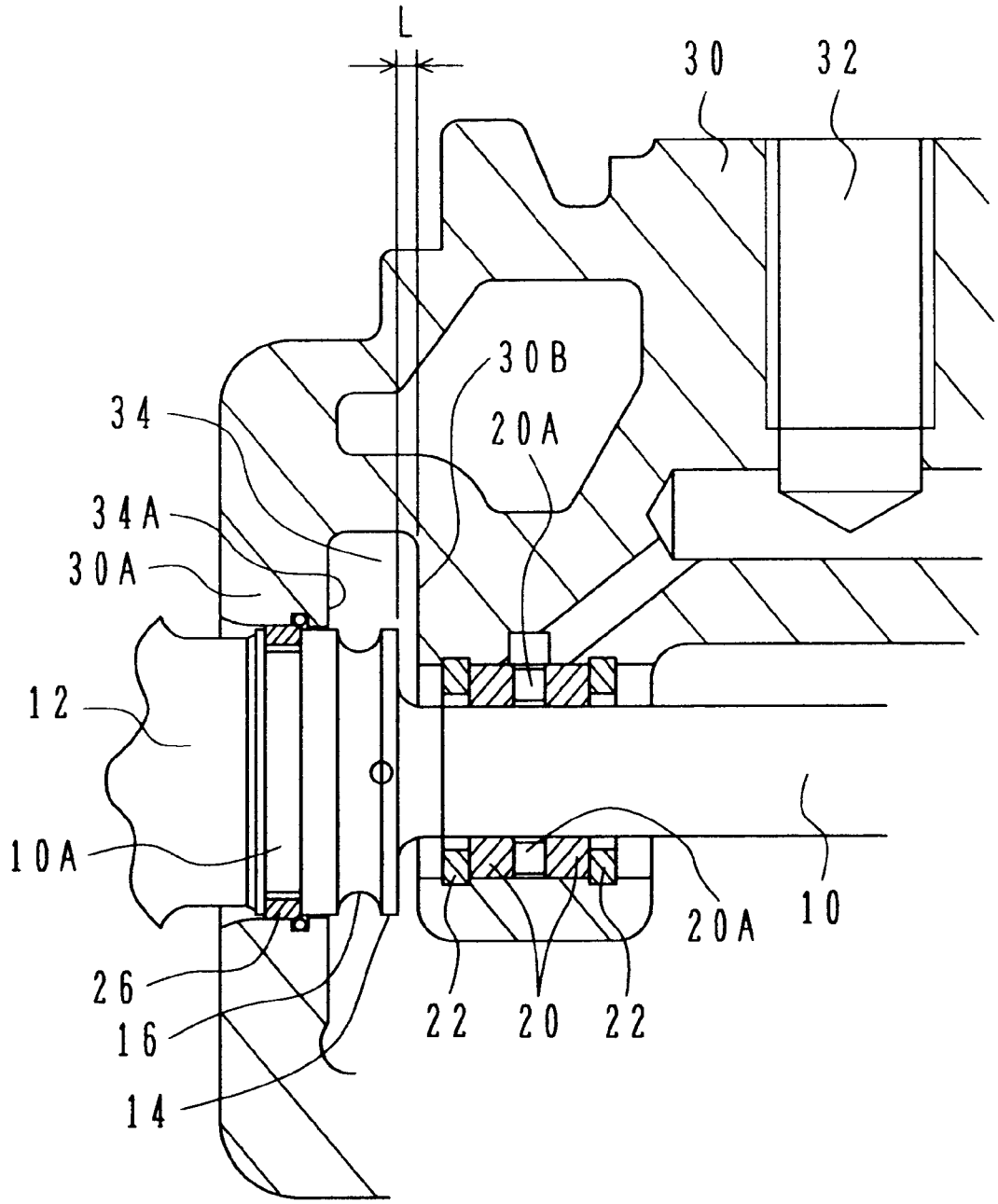
FIG. 2 is an expanded sectional view of a critical portion of the exhaust turbocharger shown in FIG. 1.

FIG. 1 is a partial sectional-view showing the configuration of the exhaust turbocharger for an internal combustion engine according to the first embodiment of the present invention. FIG. 2 is an expanded sectional view of a critical portion of the exhaust turbocharger shown in FIG. 1. In FIGS. 1 and 2, the same components are referred to by using the same reference numerals.

In FIG. 1, a turbine impeller 12 is provided at one end of a turbine shaft 10. The turbine shaft 10A is provided with a compressor impeller (not shown) at the other end thereof. The turbine shaft 10 is rotatably supported by a bearing housing 30 via a radial bearing 20. The turbine impeller 12 is received in a turbine housing 40. The turbine housing 40 is fixed to the bearing housing 30.

An oil-supply path 32 is formed in the bearing housing 30. Lubrication oil is supplied from the outside to the radial bearing 20 through the oil-supply path 32. An oil drain chamber 34 is formed inside the bearing housing 30 at the turbine impeller 12 side of the radial bearing 20. The oil having lubricated the radial bearing 20 is removed to the outside from the oil drain chamber 34. The removed oil is again supplied through the oil-supply path 32 for lubricating the radial bearing 20.

A stepped part 14 is formed toward the turbine impeller 12 side of the turbine shaft 10. A groove 16 is formed between the stepped part 14 and the turbine impeller 12.

The configuration in the vicinity of the radial bearing 20 is described below in detail with reference to FIG. 2.

The radial bearing 20 is annular. The radial bearing 20 is provided with a plurality of through-holes 20A formed in an axially intermediate part and in the periphery of the radial bearing 20. The oil from the oil-supply path 32 is supplied to the radial bearing 20 through the through-holes 20A, and lubricates the radial bearing 20. C-shaped snap rings 22 and 24 are provided at the ends of the radial bearing 20. The snap rings 22 and 24 mate with grooves formed in the inner periphery of the bearing housing 30 at the outer peripheries of the snap rings 22 and 24, whereby the radial bearing 20 is prevented from moving in the radial directions and the radial bearing 20 is supported by the bearing housing 30.

A groove 10A is formed at the turbine impeller 12 side of the turbine shaft 10 and in a part opposing an end 30A of the bearing housing 30. A seal ring 26 is inserted in the groove 10A, the seal ring 26 preventing the oil from leaking to the turbine impeller 12 side from the oil drain chamber 34 side.

The stepped part 14 is formed at the turbine impeller 12 side of the turbine shaft 10 and in the oil drain chamber 34. The groove 16 is formed between the stepped part 14 and the turbine impeller 12.

The oil having lubricated the radial bearing 20 moves along the turbine shaft 10 toward the turbine impeller 12. When the turbine shaft 10 rotates, the oil having moved to the stepped part 14 spatters in radial directions, reaches the inner wall of the oil drain chamber 34, and is removed from a lower part of the oil drain chamber 34. The oil, which reaches the inner wall of the oil drain chamber 34 and falls into the groove 16, spatters, by taking advantage of the shape of the groove 16, in radial directions toward the outside by a centrifugal force, again reaches the inner wall of the oil drain chamber 34, and is removed from the lower part of the oil drain chamber 34. However, the oil, which reaches an inner-wall surface 34A disposed at the turbine impeller 12 side of the oil drain chamber 34, penetrates into a gap between the turbine shaft 10 and the bearing housing 30. A pressure difference $\Delta P$ (Pt−Ph) between pressure Pt at the turbine impeller 12 side of the seal ring 26 and pressure Ph at the oil drain chamber 34 side respectively applied to the seal ring 26 varies in pulsation between a positive pressure and a negative pressure. When the pressure difference $\Delta P$ is negative, the oil leaks to the turbine impeller 12 side.

The inventors paid attention to a distance L from an end 30B of the bearing housing 30 at the free-end side of the radial bearing 20 to the stepped part 14 of the turbine shaft 10, and examined a spattering state of the oil. The result of the examination is described below with reference to FIG. 3.

Figure 3:
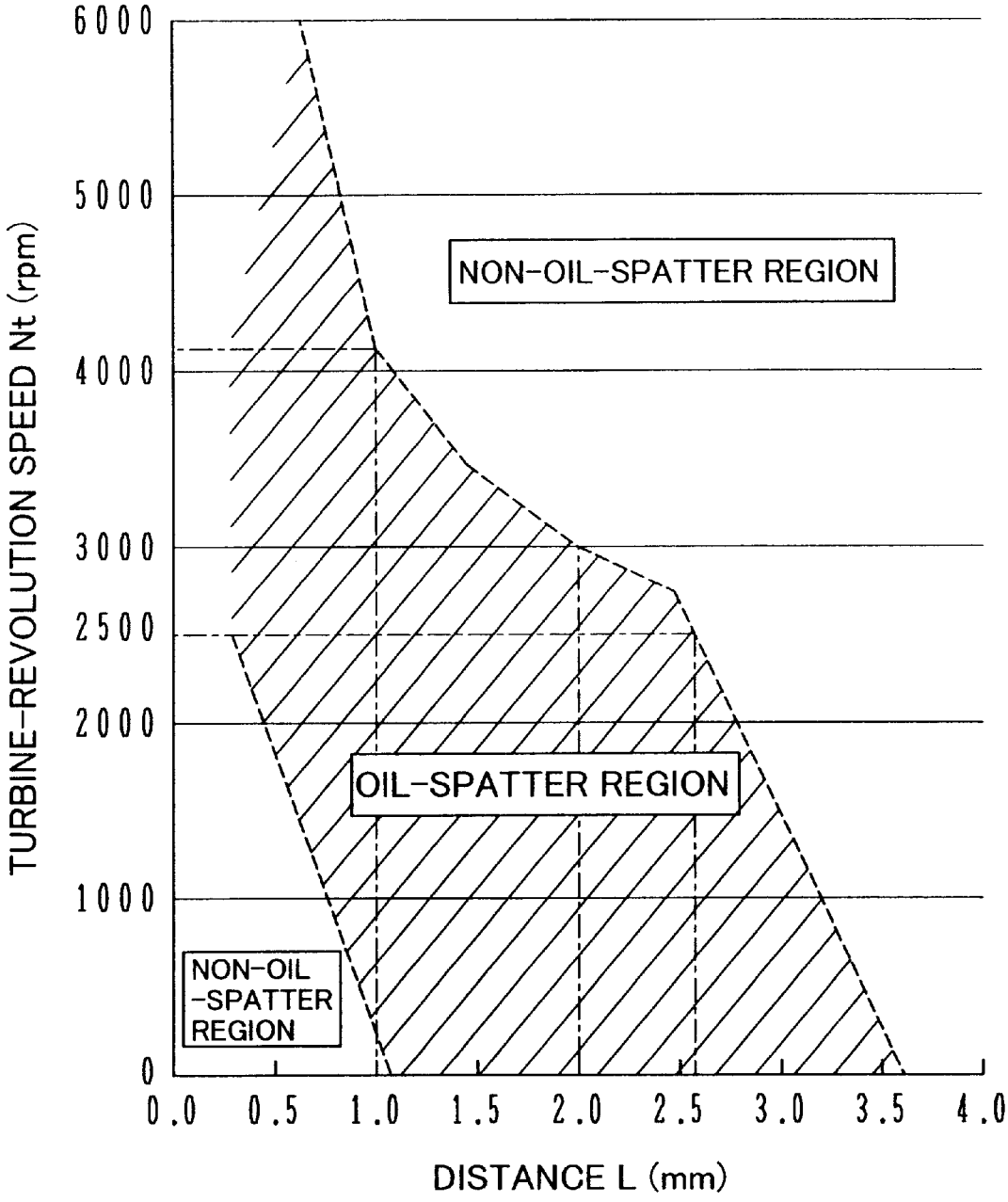
FIG. 3 is a graph showing an oil-spattering state in the exhaust turbocharger for an internal combustion engine, according to the first embodiment of the present invention.

With reference to FIG. 3, the spattering state of the oil in the exhaust turbocharger for an internal combustion engine, according to the present embodiment is described below.

FIG. 3 is a graph showing an oil-spatter state in the exhaust turbocharger for an internal combustion engine, according to the first embodiment of the present invention.

In FIG. 3, the horizontal axis indicates a distance L (mm) from the end 30B of the bearing housing 30 at the free-end side of the radial bearing 20 to the stepped part 14 of the turbine shaft 10, and the vertical axis indicates a turbine-revolution speed Nt (rpm).

In a known turbocharger, the distance L was 1.0 mm. It was found that oil spattered when the turbine-revolution speed Nt was 4200 rpm or less. In contrast, the turbine revolution speed Nt, at which the oil did not spatter, lowered as the distance L increased, and the oil-spatter was more suppressed as the turbine-revolution speed was increased.

Based on the above oil-scattering state, the movement of the oil was examined. The oil, which leaked from the end 30B of the bearing housing 30 disposed at the free end side of the radial bearing 20, moved along the turbine shaft 10 toward the stepped part 14. When the turbine-revolution speed Nt was on a higher level, the oil which had lubricated the radial bearing 20 moved along a wall surface of a radial-bearing-supporting part, and was discharged into the oil drain chamber 34, by a centrifugal force generated by the rotation of the turbine shaft 10 and by gravitation. As the turbine-revolution speed Nt lowered, the effect on the oil of the centrifugal force generated by the revolution of the turbine shaft 10 decreased, and the oil came out toward the stepped part 14 side of the turbine shaft 10. When the turbine-revolution speed Nt further lowered, the oil reached the stepped part 14 of the turbine shaft 10, and started to spatter in the radial directions toward the outside by the centrifugal force by the revolution of the turbine shaft 10 and into the oil drain chamber 34. As the distance L was greater, the length by which the oil must move became greater, whereby the oil was less likely to reach the stepped part 14. Therefore, the oil was less likely to spatter even when the turbine-revolution speed Nt was reduced.

The amount of oil leakage is proportional to a gap (((D−d)/2) between an inner diameter D of a hole for receiving the radial bearing 20 and an outer diameter d of the turbine shaft 10 when the turbine shaft 10 is disposed coaxially with the hole. Therefore, the amount of the oil which spatters can be suppressed by setting the distance L between the end 30B of the bearing housing 30 at the free end side of the radial bearing 20 and the stepped part 14 of the turbine shaft 10 to a value not smaller than the gap ((D−d)/2) between the inner diameter D of the hole for receiving the radial bearing 20 and the outer diameter d of the turbine shaft 10. In an example shown in FIG. 3, the inner diameter D of the hole for receiving the radial bearing 20 was 10 mm and the outer diameter d of the turbine shaft 10 was 6 mm, that is, the gap ((D−d)/2) was 2 mm. Therefore, by setting the distance L to 2.0 mm, the turbine revolution speed Nt at which the oil starts to spatter can be reduced to 3000 rpm.

Since a turbine-revolution speed Nti during idling of the engine was 2500 rpm, the distance L must be not less than 2.6 mm (not less than 1.3 times the gap ((D−d)/2)) so that the oil did not spatter.

When the distance L is set to 2.8 mm (1.4 times or more the gap (((D−d)/2)), the turbine-revolution speed Nti can be reduced to 2000 rpm so that the oil does not spatter.

By suppressing the oil-spatter, the oil can be prevented from adhering to the inner-wall surface 34A at the turbine impeller 12 side of the oil drain chamber 34, whereby the oil can be prevented from penetrating into the gap between the turbine shaft 10 and the bearing housing 30, thereby suppressing oil leakage to the turbine impeller 12 side.

By setting the distance L to a value at which the oil does not spatter, the oil can be prevented from penetrating into the gap between the turbine shaft 10 and the bearing housing 30, thereby suppressing oil leakage to the turbine impeller 12 side. The distance L at which the oil does not spatter is defined as a distance at which the oil, which has leaked from the end 30B of the bearing housing 30 at the free end side of the radial bearing 20 and has moved along the turbine shaft 10, does not reach the stepped part 14.

According to the embodiment described above, the oil-spatter in the oil drain chamber 34 can be suppressed, thereby reducing oil leakage to the turbine impeller 12 side.

An exhaust turbocharger for an internal combustion engine, according to a second embodiment, is described below with reference to FIGS. 4 to 6.

The configuration of the exhaust turbocharger for an internal combustion engine, according to the embodiment, is described with reference to FIGS. 4 and 5.

Figure 4:
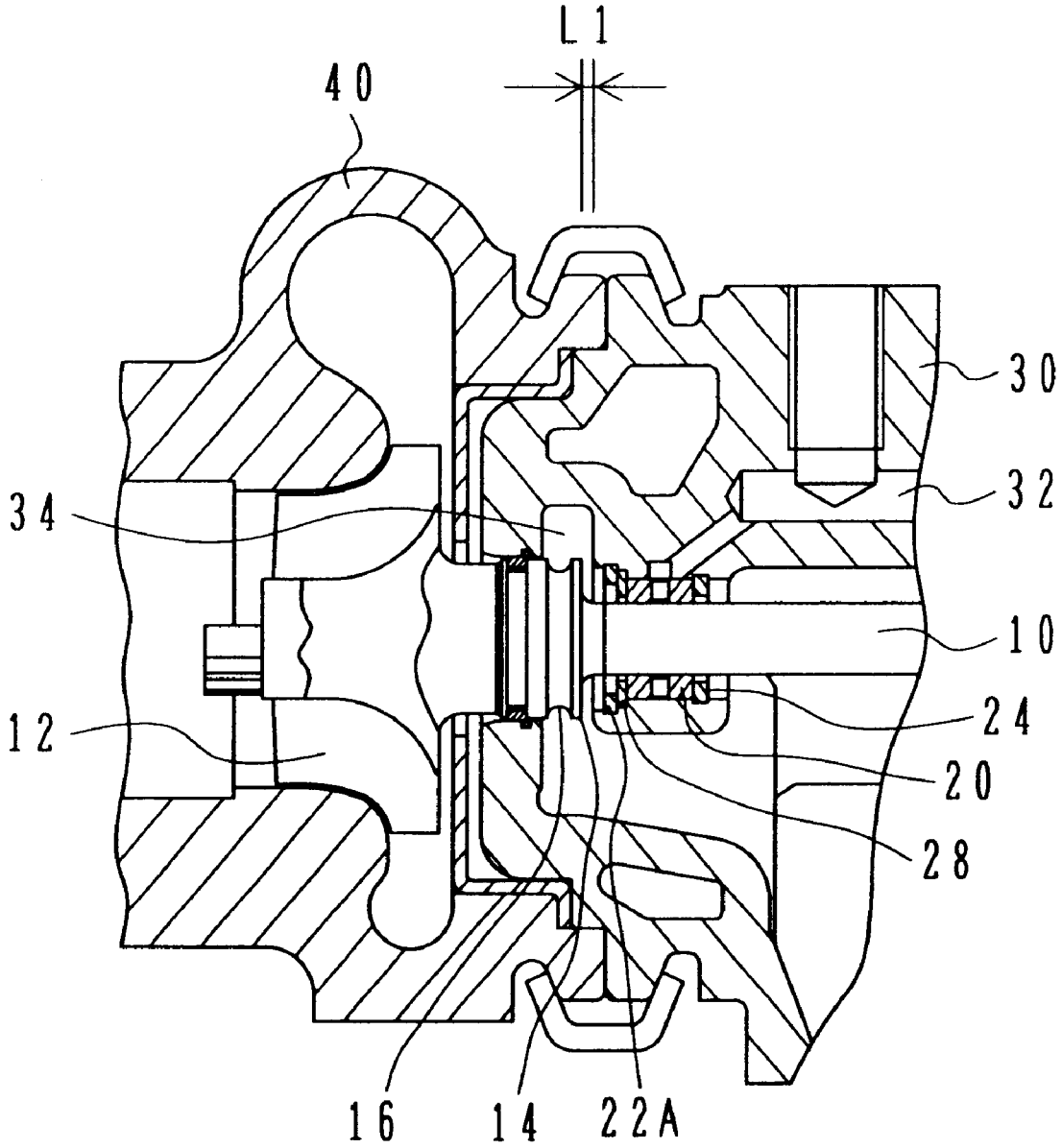
FIG. 4 is a partial sectional-view of an exhaust turbocharger for an internal combustion engine, according to a second embodiment of the present invention.
Figure 5:
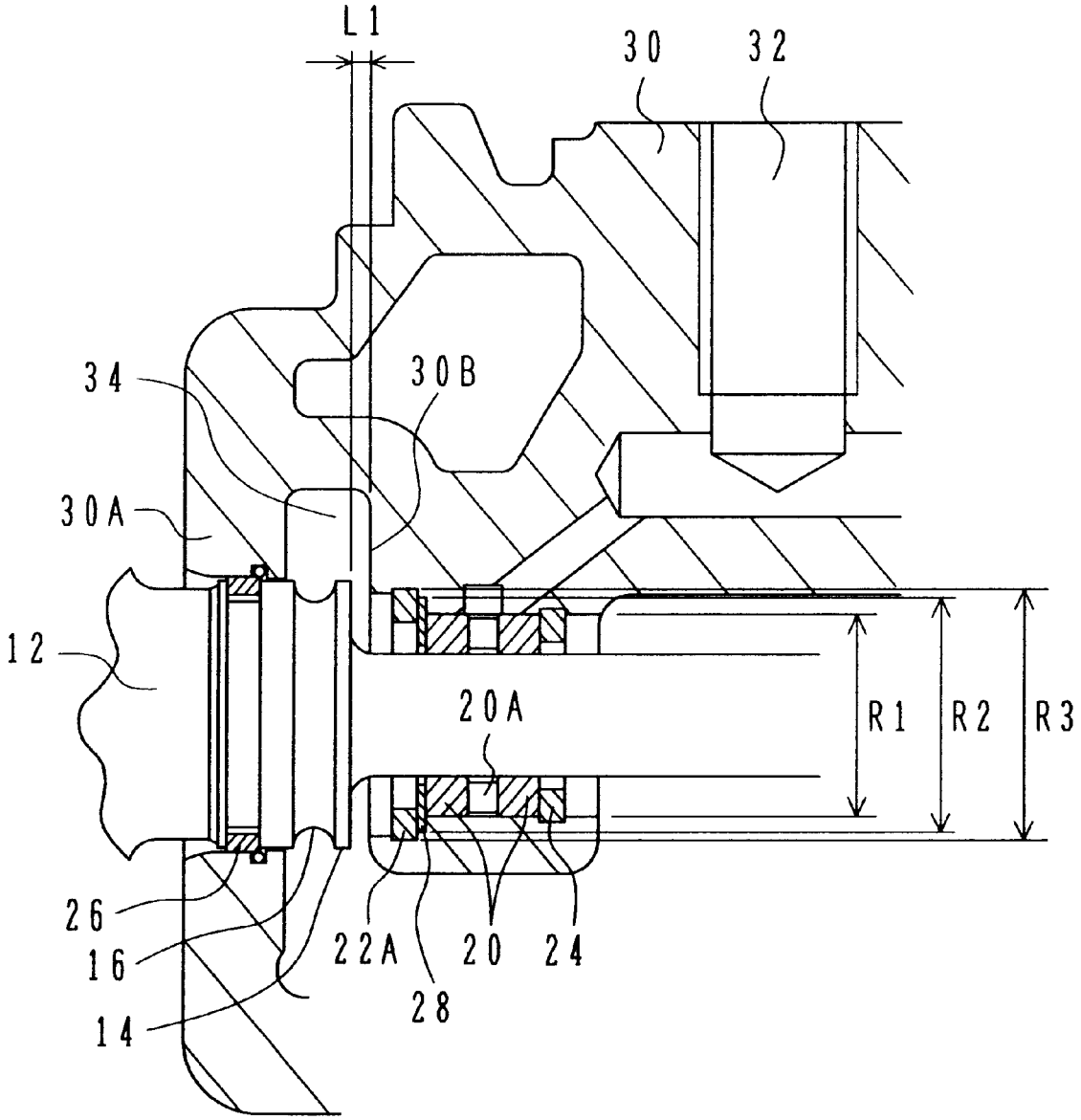
FIG. 5 is an expanded sectional view of a critical portion of the exhaust turbocharger shown in FIG. 4.

FIG. 4 is a partial sectional-view of the exhaust turbocharger for an internal combustion engine, according to the second embodiment of the present invention. FIG. 5 is an expanded sectional view of the exhaust turbocharger shown in FIG. 4. The same components as those shown in FIGS. 1 and 2 are referred to with the same reference numerals.

The basic configuration of the exhaust turbocharger for an internal combustion engine, according to the second embodiment of the present invention, is the same as the configuration of the exhaust turbocharger shown in FIG. 1. The exhaust turbocharger according to the second embodiment differs from that which is shown in FIG. 1 in the configuration in the vicinity of the radial bearing 20. In the exhaust turbocharger according to the second embodiment, snap rings 22A and 24 are provided respectively at the ends of the radial bearing 20. A plate 28 is inserted between the snap ring 22A and the radial bearing 20.

The configuration in the vicinity of the radial bearing 20 is described below in detail with reference to FIG. 5.

The radial bearing 20 is annular. The radial bearing 20 is provided with a plurality of through-holes 20A formed in an axially intermediate part and in the periphery of the radial bearing 20. Oil from an oil-supply path 32 is supplied to the radial bearing 20 through the through-holes 20A, and lubricates the radial bearing 20. A C-shaped snap ring 24 is provided at one end (the end to the right in the drawing) of the radial bearing 20. A C-shaped snap ring 22A is provided at the other end (the end to the left in the drawing) of the radial bearing 20 via the plate 28. The plate 28 is annular. The snap rings 22A and 24 mate with grooves formed in the inner periphery of the bearing housing 30 at the outer peripheries of the snap rings 22A and 24, whereby the radial bearing 20 is prevented from moving in the radial directions and the radial bearing 20 is supported by the bearing housing 30.

When the outer diameter of the radial bearing 20 is set to a value R1, an outer diameter R2 of the plate 28 is set so as to be R2>R1. An outer diameter R3 of the snap ring 22 is set so as to be R3>R2. The snap ring 22A is formed in a C-shape, as described above, that is, a portion of the peripheral part of the snap ring 22A is cut away. In the exhaust turbocharger according to the first embodiment which has a configuration shown in FIG. 2, the oil, which has moved toward the turbine impeller 12 from the gap between the outer periphery of the radial bearing 20 and the inner-wall of the bearing housing 30, leaks to the turbine impeller 12 side through the cut-away portion of the snap ring 22 shown in FIG. 2 having the same C-shape as the snap ring 22A. According to the second embodiment, the outer diameter R2 of the plate 28 is set greater than the outer diameter R1 of the radial bearing 20, and the plate 28 is formed in an annular shape, whereby the oil, which has moved toward the turbine impeller 12 from the gap between the outer periphery of the radial bearing 20 and the inner wall of the bearing housing 30, is blocked by the plate 28 so that the oil is not likely to leak to the turbine impeller 12 side.

Figure 6:
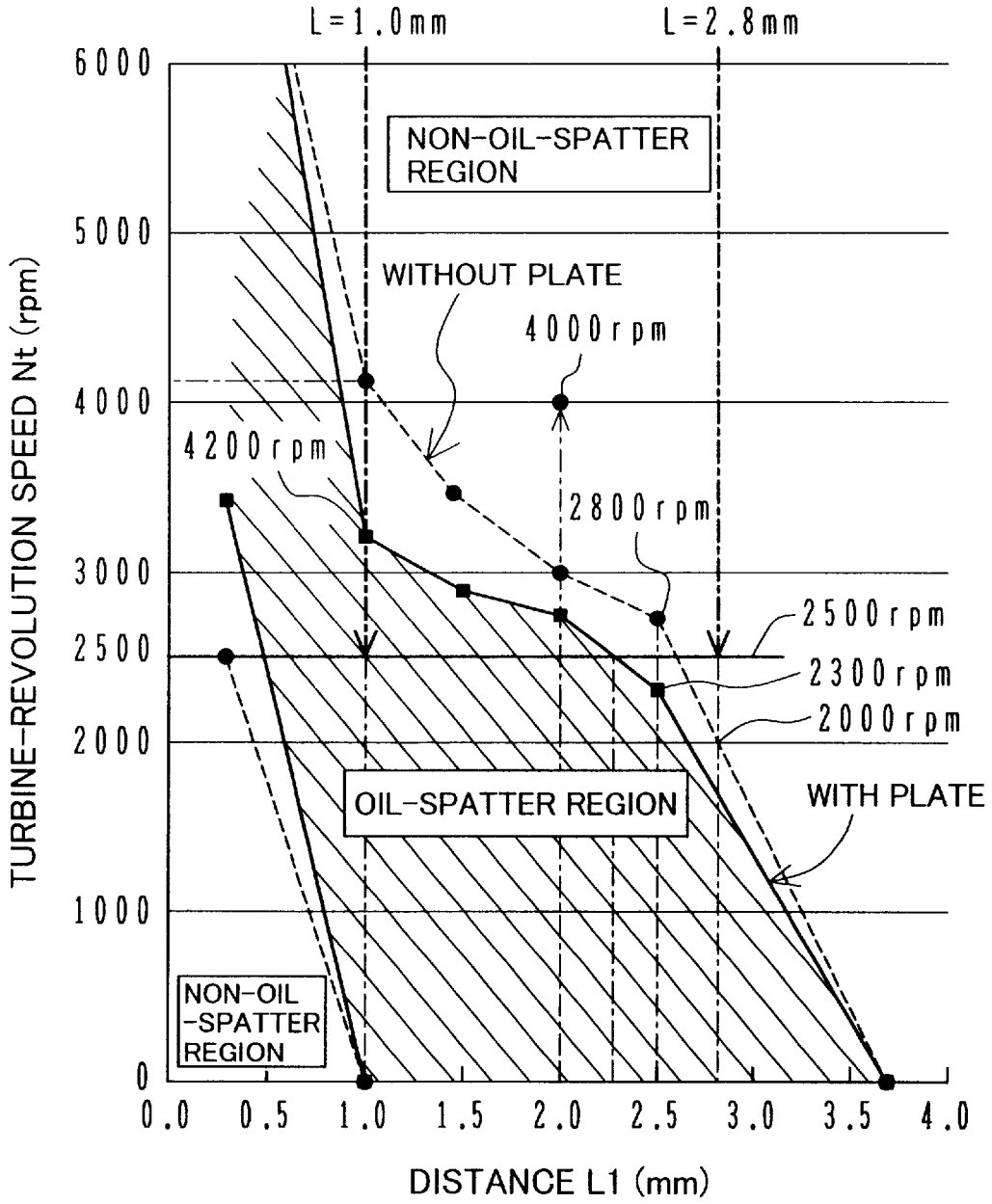
FIG. 6 is a graph showing the oil-spattering state in the exhaust turbocharger according to the second embodiment of the present invention.

With reference to FIG. 6, the spattering state of the oil in the exhaust turbocharger for an internal combustion engine, according to the embodiment, is described below.

FIG. 6 is a graph showing an oil-spatter state in the exhaust turbocharger for an internal combustion engine, according to the second embodiment of the present invention.

In FIG. 6, the horizontal axis indicates a distance L1 (mm) from an end 30B of the bearing housing 30 at the freeend side of the radial bearing 20 to a stepped part 14 of the turbine shaft 10, and the vertical axis indicates a turbine-revolution speed Nt (rpm).

In FIG. 6, a region enclosed by dashed lines is an oil-spatter region shown in FIG. 3. A region enclosed by solid lines and shown by slanted lines is the oil-spatter region when using the plate 28 according to the second embodiment. That is, the oil-spatter region can be reduced by using the plate 28, as shown by the graph in FIG. 6.

Since the turbine-revolution speed Nti during idling of the engine is 2500 rpm, as described in the first embodiment, the distance L1 must be not less than 2.25 mm (not less than 1.125 times the gap ((D−d)/2)) so that the oil does not spatter, according to the second embodiment.

When the distance L1 is set to 2.5 mm (1.25 times or more the gap (((D−d)/2)), the turbine-revolution speed Nti, at which the oil starts to spatter, can be reduced to 2300 rpm so that the oil does not spatter. When L1=2.5 mm, a turbine-revolution speed Nto at which the oil starts to spatter, which is 2800 rpm when the plate 28 is not provided, can be reduced to 2300 rpm by providing the plate 28, that is, the turbine-revolution speed Nto becomes lower than 2500 rpm which is the turbine-revolution speed when the engine is idling, thereby avoiding oil-spatter during idling.

By suppressing the oil-spatter, the oil can be prevented from adhering to an inner-wall surface 34A at the turbine impeller 12 side of an oil drain chamber 34, whereby the oil can be prevented from penetrating into a gap between the turbine shaft 10 and the bearing housing 30, thereby suppressing oil leakage to the turbine impeller 12 side.

By setting the distance L1 to a value at which the oil does not spatter, the oil can be prevented from penetrating into the gap between the turbine shaft 10 and the bearing housing 30, thereby suppressing oil leakage to the turbine impeller 12 side. The distance L1 at which the oil does not spatter is defined as a distance at which the oil, which has leaked from the end 30B of the bearing housing 30 at the free end side of the radial bearing 20 and has moved along the turbine shaft 10, does not reach the stepped part 14.

According to the second embodiment described above, the oil-spatter in the oil drain chamber 34 can be suppressed, thereby reducing oil leakage to the turbine impeller 12 side. By using the plate 28, the oil leakage can be more reduced.

The configuration and the operation of an engine system including an exhaust turbocharger for an internal combustion engine, according to a third embodiment of the present invention, are described below with reference to FIGS. 7 and 8.

The overall engine system including the exhaust turbocharger for an internal combustion engine, according to the embodiment, is described with reference to FIG. 7.

Figure 7:
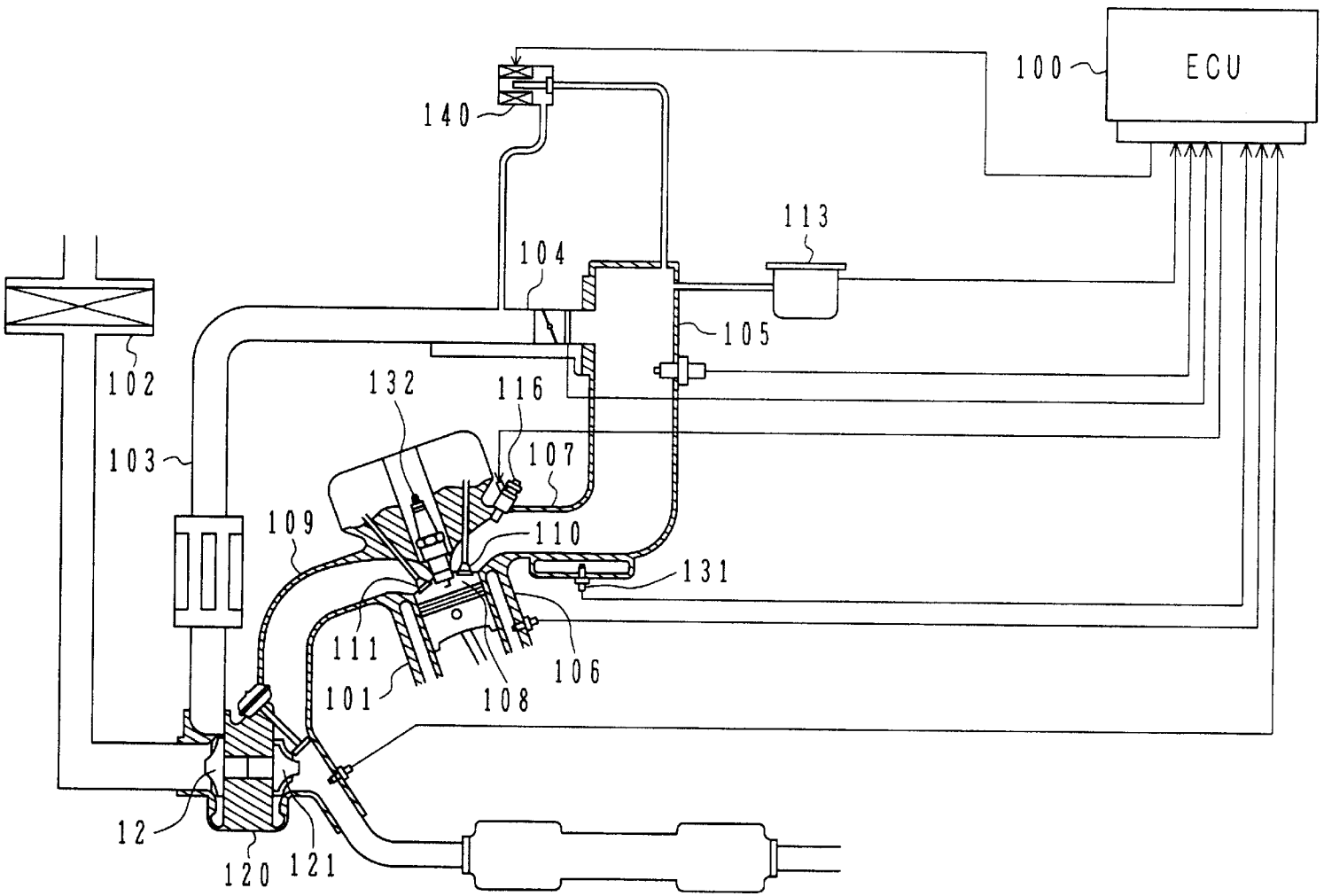
FIG. 7 is an illustration showing a turbocharging system including the exhaust turbocharger according to the first embodiment of the present invention.

FIG. 7 is an illustration of a turbocharging system including the exhaust turbocharger for an internal combustion engine, according to the third embodiment of the present invention.

Air flowing to an engine 101 is taken in through an air cleaner 102, supercharged by a turbine impeller 12 of a turbocharger 120 disposed in an intake pipe 103, passes through a throttle valve 104, and comes into a collector 105. The air taken into the collector 105 is distributed to each intake pipe 107 connected to cylinders 106 of the engine 100, and is introduced into a combustion chamber 108 of each cylinder 106. Exhaust burnt gas from each combustion chamber 108 passes through an exhaust pipe 109, rotates a compressor impeller 121 of the turbocharger 120, and is discharged to the outside. An intake valve 110 and an exhaust valve 111 are individually disposed in parts in which the intake pipe 107 and the exhaust pipe 109 are respectively connected to the combustion chamber 108, the intake valve 110 and the exhaust valve 111 being opened and closed by a cam mechanism. The throttle valve 104 is provided with a throttle sensor. The intake pipe 107 disposed downstream from the throttle valve 104 is provided with a pressure sensor 113. Fuel, such as gasoline, is injected into the intake pipe 107 by an injector 116. The cylinder 106 is provided with a water-temperature sensor 131.

Output signals from the sensors are inputted to an engine control unit (ECU) 100, and the engine-water temperature as a parameter of the operational state of the engine 101, the angular speed and rotational speed of the crankshaft, the pressure in the intake pipe, the pushed-down-amount of the acceleration pedal, and the amount of opening of the throttle valve 104 are measured or computed. The engine control unit 100 computes ignition timing and fuel-injection timing and amount in accordance with the computed parameter of the operational state of the engine, the pushed-down-amount of the acceleration pedal, and the amount of opening of the throttle valve 104. The engine control unit 100 operates actuators such as ignition plugs 132, the injector 116, and the throttle valve 104, thereby controlling the operation of the engine and the throttle valve.

The configuration of the turbocharger 120 is shown in FIGS. 1 and 4. A flow-path bypassing the throttle valve 104 and communicating between the intake pipe 103 and the collector 105 is provided with an idle-up valve 140. The idle-up valve 140 is controlled to be opened and closed by the engine control unit 100. By opening the idle-up valve 140, the volume of intake air increases, thereby increasing the revolution speed of the engine.

A controlling method in an engine system including the exhaust turbocharger for an internal combustion engine, according to the embodiment, is described below with reference to FIGS. 8A and 8B.

Figure 8A:
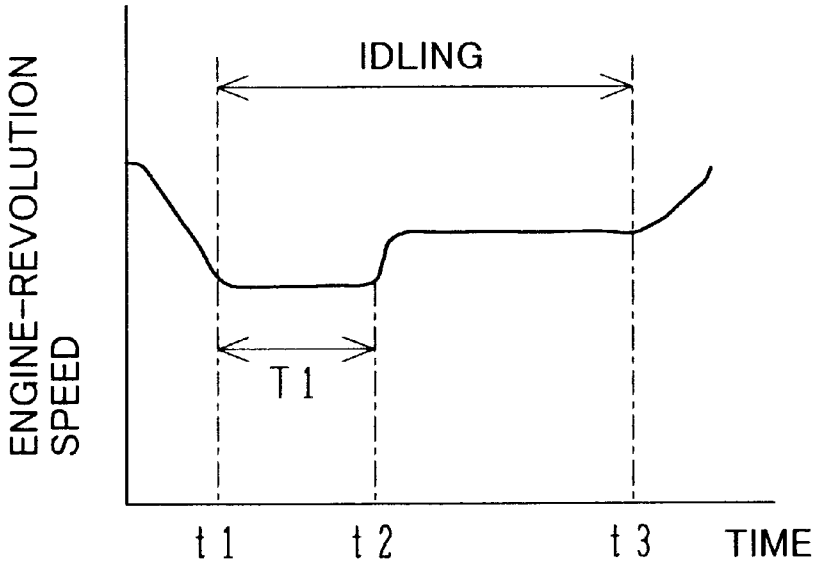
FIGS. 8A and 8B are graphs showing a control method by using a turbocharging system including an exhaust turbocharger according to a third embodiment of the present invention.
Figure 8B:
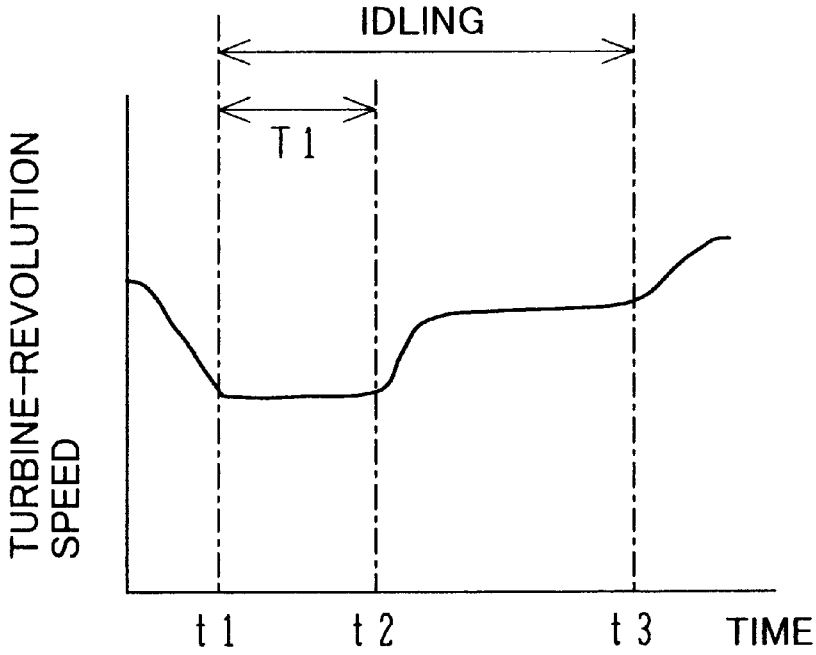

FIGS. 8A and 8B are illustrations showing the controlling method in a turbocharging system including the exhaust turbocharger for an internal combustion engine, according to the third embodiment of the present invention.

In FIG. 8A, the vertical axis indicates enginerevolution speed. In FIG. 8B, the vertical axis indicates turbine-revolution speed. In FIGS. 8A and 8B, each horizontal axis indicates time.

In FIGS. 8A and 8B, the engine idles during time t1 to t3. The engine control unit 100 determines whether or not the engine is in an idling operation, and when the engine control unit 100 determines that the idling operation continues for a time T1, the engine control unit 100 opens the idle-up valve 140 so as to increase the engine-revolution speed, thereby controlling for increasing the turbine-revolution speed. That is, idling speed is controlled so as to be increased after an idling operation continues for the predetermined time T1.

When the turbocharger has a configuration shown in FIG. 4, that is, when the turbocharger includes the plate 28, and the distance L1 is set to 2.0 mm, the turbine-revolution speed Nto at which oil-spatter starts is 2800 rpm. When an engine continues idling for the time T1 at an idling speed of 800 rpm which produces a turbine-revolution speed Nt of 2500 rpm, the turbine revolution speed Nt is increased to 4000 rpm by increasing the engine idling speed to 950 rpm, whereby oil-spatter can be avoided.

Although the turbocharger including the plate 28 is used in the third embodiment, the turbocharger shown in FIG. 1 which does not include the plate 28 may be used, in which the turbine-revolution speed can be increased to 4000 rpm by increasing the engine idling speed to 950 rpm, whereby oil-spatter can be avoided, as shown in FIG. 3. Thus, the oil-spatter can be avoided, without changing the configuration of the turbocharger, by increasing the turbine-revolution speed Nti corresponding to an engine idling speed so as to exceed the turbine-revolution speed Nto at which the oil-spatter starts.

As described above, the oil-spatter can be suppressed by controlling the engine, according to the present embodiment.

According to the present invention, oil leakage in an exhaust turbocharger for an internal combustion engine can be reduced.

What is claimed is:

1. An exhaust turbocharger for an internal combustion engine, the exhaust turbocharger comprising:

a turbine shaft fixed to a turbine impeller to be driven for rotation by exhaust gas of the internal combustion engine;

a radial bearing mounted to a bearing housing, for supporting the turbine shaft in radial directions, the bearing housing including an oil drain for discharging oil which has lubricated the radial bearing; and a stepped part formed on the turbine shaft between the turbine impeller and the radial bearing so that the outer diameter of the turbine shaft is greater at the turbine impeller side than at the radial bearing side, wherein the distance L from a side face of the radial bearing to the stepped part is set to a value at which oil moving from an end of the radial bearing does not reach the stepped part when a turbine-revolution speed Nt is higher than that Nti which is produced by an idling operation of the internal combustion engine.

2. An exhaust turbocharger for an internal combustion engine, the exhaust turbocharger comprising:

a turbine shaft fixed to a turbine impeller to be driven for rotaiton by exhaust gas of the internal combustion engine;

a radial bearing mounted to a bearing housing, for supporting the turbine shaft in radial directions, the bearing housing including an oil drain for discharging oil which has lubricated the radial bearing; and a stepped part formed on the turbine shaft between the turbine impeller and the radial bearing so that the outer diameter of the turbine shaft is greater at the turbine impeller side than at the radial bearing side, wherein the oil drain is formed so as to open toward the turbine impeller side from a supporting part of the radial bearing and to enclose the stepped part of the turbine shaft; and wherein the distance L from a side face of the radial bearing, at which the turbine shaft becomes free from the radial bearing, to the stepped part of the turbine shaft is set to a value greater than a gap produced by a difference between an inner diameter D of a hole for receiving the radial bearing and an outer diameter d of the turbine shaft when the turbine shaft is disposed coaxially with said hole.

3. An exhaust turbocharger for an internal combustion engine, according to claim 1, wherein an annular plate inserted at an outer side of said turbine shaft is provided between said side face of the radial bearing and said radial bearing.

4. A turbocharging system comprising:

an exhaust turbocharger for an internal combustion engine, the exhaust turbocharger including:

a turbine shaft fixed to a turbine impeller to be driven for rotation by exhaust gas of the internal combustion engine; and a radial bearing mounted to a bearing housing, for supporting the turbine shaft in radial directions; and control means for increasing, after an idling operation continues for a predetermined time, a rotational speed of said engine so that said rotational speed is higher than a rotational speed which causes spattering time of oil of said turbine.

5. An exhaust turbocharger for an internal combustion engine, according to claim 2, wherein the distance L is larger than a half of the difference between the inner diameter D of the hole for receiving the radial bearing and the outer diameter d of the turbine shaft.

6. A turbocharger system comprising:

an exhaust turbocharger for an internal combustion engine, the exhaust turbocharger including:

a turbine shaft fixed to a turbine impeller to be driven for rotation by exhaust gas of the internal combustion engine; and a radial bearing mounted to a bearing housing, for supporting the turbine shaft in radial directions; and control means for increasing, after an idling operation continues for a predetermined time, a rotational speed of said turbine so that said rotational speed is higher than a rotational speed of said turbine at idling speed.

* * * * *